US008052072B2

(12) United States Patent
Kriesmair

(10) Patent No.: US 8,052,072 B2
(45) Date of Patent: Nov. 8, 2011

(54) DEVICE FOR SPRAYING ON PIGMENTED LIQUIDS

(76) Inventor: Bernd Kriesmair, München (DE)

( * ) Notice: Subject to any disclaimer, the term of this patent is extended or adjusted under 35 U.S.C. 154(b) by 0 days.

(21) Appl. No.: 12/532,952

(22) PCT Filed: Mar. 31, 2008

(86) PCT No.: PCT/EP2008/002534

§ 371 (c)(1),
(2), (4) Date: Feb. 22, 2010

(87) PCT Pub. No.: WO2008/125209

PCT Pub. Date: Oct. 23, 2008

(65) Prior Publication Data

US 2010/0224701 A1 Sep. 9, 2010

(30) Foreign Application Priority Data

Apr. 11, 2007 (DE) ..... 10 2007 016 992

(51) Int. Cl.
*B05B 7/30* (2006.01)

(52) U.S. Cl. ..... 239/346; 239/319; 239/302; 239/353; 239/414; 239/419

(58) Field of Classification Search ..... 239/302, 239/319, 340, 346, 353, 414, 419
See application file for complete search history.

(56) References Cited

U.S. PATENT DOCUMENTS

| | | | | |
|---|---|---|---|---|
| 595,931 | A * | 12/1897 | Wold | 239/414 |
| 649,431 | A | 5/1900 | Burdick | |
| 2,959,358 | A | 11/1960 | Vork | |
| 4,102,500 | A | 7/1978 | Luff | |
| 4,685,622 | A | 8/1987 | Shimohira et al. | |
| 5,156,684 | A | 10/1992 | Mayer et al. | |
| 5,366,158 | A | 11/1994 | Robisch et al. | |
| 5,454,517 | A | 10/1995 | Naemura | |
| 6,098,902 | A | 8/2000 | Culbertson et al. | |
| 6,105,881 | A * | 8/2000 | Kitajima | 239/353 |
| 6,796,514 | B1 | 9/2004 | Schwartz | |
| 7,090,149 | B2 * | 8/2006 | Fedorov | 239/346 |
| 7,389,948 | B1 * | 6/2008 | Lampman | 239/353 |
| 2002/0166902 | A1 | 11/2002 | Pettit et al. | |
| 2004/0065755 | A1 | 4/2004 | Turnbull | |

FOREIGN PATENT DOCUMENTS

CA 2618816 A1 2/2007

(Continued)

*Primary Examiner* — Steven J Ganey
(74) *Attorney, Agent, or Firm* — Browdy and Neimark, PLLC

(57) ABSTRACT

In a device for spraying on pigmented liquids by means of an air flow comprising a base body, a spray nozzle disposed at the front side of the base body, wherein a needle is disposed centrally in the spray nozzle, a compressed air inlet and an adjacent compressed air duct, an outlet opening for a pigmented liquid, wherein a controllable compressed air flow is supplied via the compressed air duct and is guided past the outlet opening for the pigmented liquid where it is loaded with droplets of liquid, these droplets of liquid being discharged through the spray nozzle as long as the compressed air flow is maintained, wherein the nozzle and the needle are disposed in a nozzle head that is removable or replaceable, respectively, as a whole, it is provided that a receptacle for the pigmented liquid to be sprayed on is disposed in the nozzle head.

8 Claims, 2 Drawing Sheets

FOREIGN PATENT DOCUMENTS

| | | | |
|---|---|---|---|
| DE | 25 55 224 | | 6/1977 |
| DE | 195 25 611 | | 1/1997 |
| DE | 102005038162 | A1 | 2/2007 |
| EP | 04 82 569 | | 4/1992 |
| EP | 0482569 | A1 | 4/1992 |
| EP | 1 340 550 | | 9/2003 |
| GB | 102910 | A | 1/1917 |
| WO | 9219386 | A1 | 11/1992 |
| WO | 95/13881 | | 5/1995 |
| WO | 01/66261 | A2 | 3/2001 |
| WO | 2004098785 | A1 | 11/2004 |

* cited by examiner

DEVICE FOR SPRAYING ON PIGMENTED LIQUIDS

FIELD OF THE INVENTION

The invention relates to a device for spraying on pigmented liquids by means of an air flow comprising a base body, a spray nozzle disposed at the front side of the base body, wherein a needle is disposed centrally in the spray nozzle, a compressed air inlet and an adjacent compressed air duct, an outlet opening for a pigmented liquid, wherein a controllable compressed air flow is supplied via the compressed air duct and is guided past the outlet opening for the pigmented liquid where it is loaded with droplets of liquid, these droplets of liquid being discharged through the spray nozzle as long as the compressed air flow is maintained, the nozzle and the needle being disposed in a nozzle head that is removable or replaceable, respectively, as a whole.

BACKGROUND ART

Such a device is described in DE 10 2005 038 162.6.

In the known device, it is provided that the pigmented liquid is supplied via an inlet opening from an external receptacle.

SUMMARY OF THE INVENTION

Based thereon, it is the object of the invention to develop a device of the generic type in a way as to achieve an even easier manipulation.

This object is attained according to the invention by disposing a receptacle for the pigmented liquid to be sprayed on in the nozzle head. The nozzle support will then be available with an already filled receptacle; alternatively, the receptacle may be individually filled or refilled, respectively.

To this end, a fill opening may be provided that is connected with the receptacle, the fill opening preferably being covered by a slit diaphragm that may consist of silicone.

The receptacle may be disposed about the needle so as to achieve a compact, symmetrical design.

According to another preferred embodiment, the receptacle has a hollow cylindrical basic shape with a conically tapering front end area forming the outlet opening and a rear end area, a sealing element being inserted into the rear end area of the receptacle. The two mentioned end areas are disposed at the front or at the back, respectively, in relation to the axial direction, i.e. the direction defined by the central longitudinal axis of the needle. Thus, a hollow space is formed inside the receptacle for receiving the pigmented liquid, the hollow space being sealed to the front and to the back. Sealing to the back is provided by the sealing element which in particular consists of Teflon. Sealing to the front is in particular performed by the needle which shuts off the outlet opening when in the rest position, i.e. in the inactive state. To this end, the needle may be force-fitted or pressed into a conically tapering seat of the outlet opening and/or be disposed in this seat in a closely-adhering manner.

According to another preferred embodiment, the sealing element closely adheres to an inner wall of the receptacle so as to provide a sealing effect. The sealing element furthermore has a passage opening through which the needle is guided in an axially movable manner, a contact between the sealing element and the needle in the passage opening being narrow enough to provide a sealing effect. The sealing element is in particular inserted into the receptacle by means of an interference fit. A form of an interference fit is preferably also provided between the needle and the sealing element, the contact force thereof advantageously being lower than between the sealing element and the inner wall of the receptacle, however, since the needle should be capable of reciprocating movement in the passage opening. This way, the two contact areas between the sealing element and the receptacle on the one hand and between the sealing element and the needle on the other hand are each designed in a tight manner, i.e. in particular so tight as to avoid a discharge of the pigmented liquid.

According to another preferred embodiment, a contact force between the sealing element and the needle guided through the sealing element is defined such as to maintain a relative position between the sealing element and the needle as long as there is no effect of an external force. An effect of an external force is in particular to be understood as the force exerted by the actuating ram of the spraying device. Above all, this ensures that the needle cannot move away from its rest position on its own and without any external action, the rest position being the position in which the needle is disposed in the seat of the outlet opening in a closely adhering manner that is in particular narrow enough to provide a sealing effect. In particular, a passage diameter of the passage opening of the sealing element is approximately 1% to approximately 5%, in particular approximately 2%, smaller than a needle diameter of the needle in the area that is situated in the passage opening when in the assembled state. According to an alternative embodiment, it is however also possible to provide an additional spring to press the needle into the seat of the outlet opening, thereby preventing an accidental opening of the outlet opening and, consequently, an unwanted leakage of the pigmented liquid stored in the receptacle.

According to another preferred embodiment, the rear end of the needle is securely but detachably connected to an actuating ram by mechanical means. This enables the nozzle head to be replaced whilst ensuring a simple and secure manipulation of the spraying device.

According to another preferred embodiment, the connection between the rear end of the needle and the actuating ram is provided by means of a positive fit. For example, a form of a detachable bayonet coupling is provided between the rear end of the needle and the actuating ram.

BRIEF DESCRIPTION OF THE DRAWING

The following is a more detailed description of the invention by means of a preferred embodiment, taken in conjunction with the drawing, in which.

DESCRIPTION OF THE PREFERRED EMBODIMENT

Figure 1:
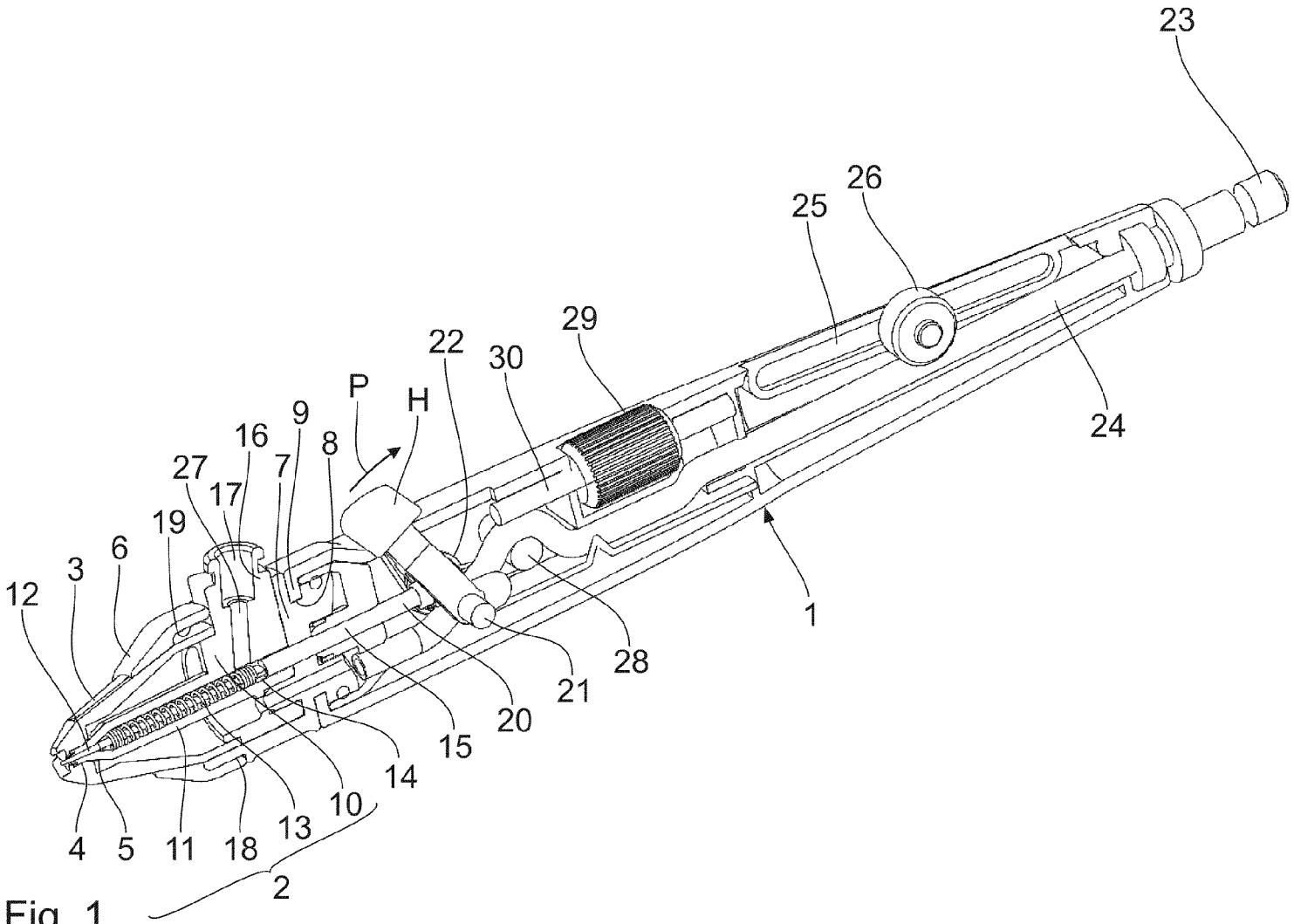
FIG. 1 shows a perspective, partially broken view of a device of the generic type as it is known from DE 10 2005 038 162.6.

An inventive device has a longitudinal base body 1 which may be handheld in a pencil-like manner, a colour-carrying nozzle part 2 being disposed at the front end thereof.

The colour-carrying nozzle part 2 comprises a conical nozzle cover 3 with a passage-and-guide bore 4 for a nozzle 5, a safety cover 6 that overlaps with the nozzle cover 3 and a ring body 7.

The ring body 7 has an annular, circumferential groove 8, a guide collar 9 of the base body 1 engaging therewith so that the ring body is mounted for rotation through 360°.

Moreover, a nozzle support 10 forming a nozzle head is disposed in the colour-carrying nozzle part 2, a nozzle pipe 11 extending away therefrom, wherein the nozzle 5 is formed on the front end of the nozzle pipe 11. A needle 12 is positioned in the nozzle pipe 11, the needle 12 being acted upon by a helical spring 13. The helical spring 13 and the needle 12 are positioned in a longitudinal bore 14 of the nozzle support 10, a longitudinally displaceable ram 15 acting into said longitudinal bore 14 as described below.

The nozzle support 10 has a substantially circular outer shape and may be form-fitted into the ring body 7, a lateral projection 16 of the nozzle support 10 engaging with a slot—not shown in the drawing—of the ring body 7 so as to be non-rotational with respect to the ring body 7, which in turn is rotatable relative to the base body 1, however.

A colour inlet 17 in the shape of a recess is formed in the projection 16, wherein either a connecting hose leading to a colour reservoir or the connecting plug of a small, directly attachable colour reservoir is insertable into the colour inlet 17.

The ring body 7 has an external thread 18 over which the internal thread 19 of the safety cover 6 may be screwed. This way, the nozzle cover 3 may be attached to the ring body 7 via the safety cover 6 whilst at the same time axially fixing the nozzle support 10 which is positioned in the front-side recess of the base body 1.

It is apparent from the above description that the entire colour-carrying nozzle part 2 is rotatable relative to the base body 1, and that the nozzle support 10, together with the colour inlet 17, the nozzle 5, the nozzle needle 12 and the helical spring 13, is replaceable in a way that no colour-carrying parts are left behind so that work may continue with another colour, i.e. upon inserting a new nozzle support 10, without any problems whatsoever.

The rear end of the nozzle needle 12 is attached to the helical spring 13, while the front end of the helical spring 13 rests against the tapered nozzle 5 in a way that a forward movement of the actuating ram 15 causes the helical spring 13 to be compressed and a backward movement of the actuating ram 15 causes the helical spring 13 to retract the nozzle needle 12.

At its inner end 20, the actuating ram 15 is attached to an actuating lever H that is operable in the direction of the arrow P and is mounted for rotation about a pivot axis 21, the actuating lever H causing the actuating ram 15 to be moved to the right or backwards, respectively, when moved in the direction of the arrow P against the force of a return spring 22, thereby enabling the helical spring 13 to move the needle 12 in the drawing to the right so that the size of the passage opening of the nozzle 5 is steadily increased when moving further to the right or backwards, respectively, thus allowing a correspondingly larger amount of colour to be delivered.

An air inlet 23 is provided at the rear end of the base body 1. An air duct 24 of a hose-like, flexible material adjoins the air inlet 23 towards the inside. A guide 25 for an adjusting wheel 26 with a knurled surface extends at an angle with respect to the air duct 24, the adjusting wheel 26 engaging with the compressed air duct 24, thus opening the latter when moved forward and closing the same when moved backward, thereby allowing the throughput of compressed air to be adjusted.

The compressed air duct 24 opens into the conically tapered nozzle cover 3, causing the air flow to be accelerated and to flow past the nozzle 5, thereby entraining the colour from a colour duct 27 adjoining the colour inlet 17 due to the low pressure generated by the Venturi effect so that a colour-air mixture is discharged through the nozzle 5.

The compressed air may for example be generated by means of a compressor. The maximum operating pressure amounts to 3 bar.

The air duct 24 is guided past the actuating lever H and is squeezed closed at 28 when the actuating lever H is in the front locking position. When the actuating lever H is moved in the direction of the arrow P, this causes the nozzle 5 to be opened due to the backward movement of the needle, thereby simultaneously opening the compressed air duct 24 as already described.

The travel of the actuating lever H may be limited or adjusted, respectively, by means of a knurled nut 29, enabling a constant thickness of the sprayed line to be maintained over a longer period of time. The knurled nut 29 is positioned on a threaded rod 30 which is axially displaced by a rotary movement of the knurled nut 29, thereby forming a displaceable stop for the actuating lever H.

In the above described device of the generic type, it is provided that the pigmented liquid is supplied from the outside via a colour inlet 17.

Figure 2:
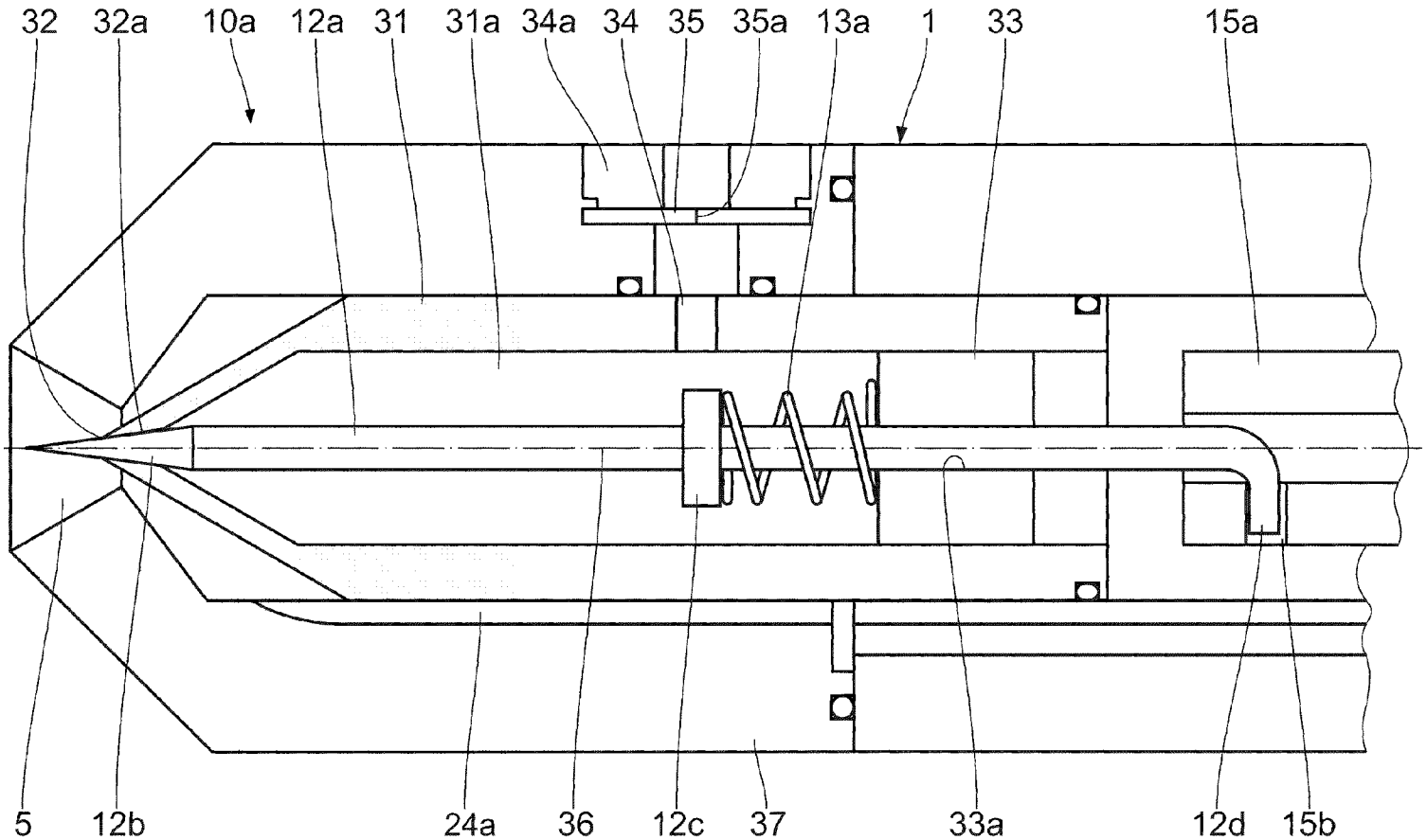
FIG. 2 shows a section through the nozzle support in accordance with the inventive solution.

In the embodiment of an inventive spraying device shown in FIG. 2, on the other hand, a replaceable nozzle head 10*a* is provided in which a needle 12*a* and a helical spring 13*a* are directly disposed in a substantially hollow cylindrical receptacle 31 for the pigmented liquid to be sprayed on. At an axial front end, the receptacle 31 tapers conically and has an outlet opening 32 whose inner wall forms a seat 32*a* that also tapers conically in the forward direction. At its front end, the needle 12*a* tapers to form a needle tip 12*b* with which the needle 12*a* passes through the outlet opening 32. In the rest position of the needle 12*a* shown in FIG. 2, the needle tip 12*b* is disposed in the seat 32*a* in a closely-adhering manner so as to prevent a leakage of liquid. The inner wall of the seat 32*a* and the outer contour of the needle tip 12*b* are matched to each other. In particular, they each have the same conicity, i.e. the same inclination angle with respect to the central longitudinal axis 36 of the needle 12*a* or the entire spraying device, respectively.

In the vicinity of the outlet opening 32, a nozzle-head air duct 24*a* ends on the outside of the receptacle tapering conically at the front end, the nozzle-head air duct 24*a* being in connection with the compressed air duct 24 shown in FIG. 1. The nozzle-head air duct 24*a* extends between the receptacle 31 and an outer nozzle cap 37 of the replaceable nozzle head 10*a*.

At an axial rear or back end of the receptacle 31, a sealing element in the shape of a Teflon seal 33 is inserted into the receptacle 31 by means of an interference fit so as to prevent a leakage of liquid. The Teflon seal 33 has a central passage opening 33*a* through which the needle 12*a* is guided. Guidance of the needle 12*a* through the passage opening 33*a* is designed such that on the one hand an axial reciprocating movement of the needle 12*a* is possible while on the other hand a tight sealing is ensured to prevent a leakage of liquid.

Thus, a receiving space 31*a* is formed in the receptacle 31 for receiving the pigmented liquid to be sprayed on. This receiving space 31*a* is defined laterally by the wall of the receptacle 31, at the front end by the needle tip 12*b* that is tightly disposed in the seat 32*a* of the outlet opening 32 when in the rest position, and at the rear end by the Teflon seal 33.

A refill opening 34 is disposed in the hollow cylindrical wall of the receptacle 31, the refill opening 34 being shut off by a slit silicone diaphragm 35. In the described embodiment, the silicone diaphragm 35 is inserted into another opening 34*a* provided in the nozzle cap 37 so as to be aligned with the refill opening 34*a*, and has a slit 35*a* that has a pressure-compensating function. When pigmented liquid is discharged from the receiving space 31*a* of the receptacle 31 during the manipulation of the spraying device, the slit 35*a* allows air to enter the receiving space 31*a*, thereby causing a pressure compensation to occur. Otherwise, the low pressure generated in the receiving space 31*a* could affect the functioning of the spraying device. On the other hand, the slit silicone diaphragm 35 is designed such that the pigmented liquid cannot be discharged through the slit 35*a*. The silicone diaphragm 35 thus has a double function, on the one hand providing for the pressure compensation whilst preventing a leakage of liquid on the other.

In the receiving space 31*a*, the needle 12*a* is provided with a stop washer 12*c* that is securely attached to the needle 12*a*, for example by gluing, pressing or welding. The helical spring 13*a* is designed as a compression spring and is clamped between the stop washer 12*c* and the Teflon seal 33, thus pressing the needle tip 12*b* of the needle 12*a* into the seat 32*a*. When the spraying device is operated, the needle 12*a* is moved backwards in the axial direction against the spring force of the helical spring 13*a*, causing the outlet opening 32*a* to open a bit.

The front of the needle 12*a* is guided by means of the conically tapering front end area of the receptacle 31, in particular by the seat 32*a* provided therein, while the back of the needle 12*a* is guided by means of the Teflon seal 33, in particular by the passage opening 33*a* thereof.

For operating the spraying device, the needle 12*a* is positively connected to an actuating ram 15*a* in a detachable manner. This connection is designed for the axial transmission of force from the actuating ram 15*a* to the needle 12*a*. To this end, the needle 12*a* has a crimped or bent fixing end portion 12*d* at its rear axial end on the side of the Teflon seal 33 facing away from the receiving space 31*a*, the fixing end portion 12*d* engaging with a corresponding radial bore 15*b* of the actuating ram 15*a* when in the assembled state. The connection is detachable, for example in the manner of a bayonet coupling, which allows the nozzle head 10*a* comprising the needle 12*a* to be replaced.

Along with the needle 12*a*, the replaceable nozzle head 10*a* also comprises the receptacle 31 with the inserted Teflon seal 33, the receptacle being more or less filled with pigmented liquid depending on the current filling state, the helical spring 13*a* and the outer nozzle cap 37 with the silicone diaphragm 35 inserted therein. The nozzle cap 37 is detachably connected to the base body 1 of the spraying device by means of suitable fixing means not shown in FIG. 2, such as a bayonet coupling. Due to the receptacle 31, the nozzle head 10*a* is equipped with an integrated liquid container. Designed in particular as a hand-held device, the inventive spraying device may therefore be operated independently of an external liquid supply, in particular without requiring a large external liquid container attached separately to the nozzle head 10*a*.

The invention claimed is:

1. A device for spraying on pigmented liquids by an airflow, said device comprising a base body (1), a spray nozzle (5) disposed at the front side of the base body (1), wherein a needle (12) is disposed centrally in the spray nozzle (5), a compressed air inlet (23) and an adjacent compressed air duct (24, 24*a*), an outlet opening (33) for a pigmented liquid, wherein a controllable compressed air flow is supplied via the compressed air duct (24, 24*a*) and is guided past the outlet opening (32) for the pigmented liquid where it is loaded with droplets of liquid, these droplets of liquid being dischargeable through the spray nozzle (5) as long as the compressed air flow is maintained, wherein the spray nozzle (5) and the needle (12; 12*a*) are disposed in a nozzle head (10; 10*a*), the nozzle head being replaceable in a way that no color-carrying parts are left behind, wherein a receptacle (31) is disposed in the nozzle head (10*a*), wherein a receiving space (31*a*) is formed in the receptacle (31) for receiving the pigmented liquids to be sprayed on, so that the nozzle head (10*a*) is equipped with an integrated liquid container and the device may be operated independently of an external liquid supply;

wherein a fill opening (34, 34*a*) is provided, the fill opening (34, 34*a*) being connected with the receptacle (31); and wherein the fill opening (34, 34*a*) is covered by a slit diaphragm (35).

2. A device according to claim 1, wherein the diaphragm (35) consists of silicone.

3. A Device according to claim 1, wherein the receptacle (31) is disposed about the needle (12*a*).

4. A device according to claim 1, wherein the receptacle (31) has a hollow cylindrical basic shape with a conically tapering front end area forming the outlet opening (32) and a rear end area, a sealing element (33) being inserted into the receptacle (31) in the rear end area.

5. A device according to claim 4, wherein the sealing element (33) closely adheres to an inner wall of the receptacle (31) such as to provide a sealing effect, the sealing element (33) having a passage opening (33*a*) through which the needle (12) is guided in an axially movable manner, a contact between the sealing element (33) and the needle (12) in the passage opening (33*a*) being narrow enough to provide a sealing effect.

6. A device according to claim 4, wherein a contact force between the sealing element (33) and the needle (12) guided through the sealing element (33) is defined such that a relative position between the sealing element (33) and the needle (12) is maintained as long as there is no effect of an external force.

7. A device according to claim 1, wherein the rear end of the needle (12) is securely but detachably connected to an actuating ram (15*a*) by mechanical means.

8. A device according to claim 7, wherein the connection between the rear end of the needle (12) and the actuating ram (15*a*) is provided by a positive fit.

* * * * *